US006859178B1

(12) United States Patent
Ryken et al.

(10) Patent No.: US 6,859,178 B1
(45) Date of Patent: Feb. 22, 2005

(54) REDUCED SIZE TM CYLINDRICAL SHAPED MICROSTRIP ANTENNA ARRAY

(75) Inventors: Marvin L. Ryken, Oxnard, CA (US); Albert F. Davis, Ventura, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 3 days.

(21) Appl. No.: 10/666,830

(22) Filed: Sep. 19, 2003

Related U.S. Application Data

(63) Continuation-in-part of application No. 10/648,715, filed on Aug. 27, 2003.

(51) Int. Cl.[7] ..... H01Q 1/38

(52) U.S. Cl. ..... 343/700 MS; 343/846; 343/853

(58) Field of Search ..... 343/700 MS, 846, 343/850, 853

(56) References Cited

U.S. PATENT DOCUMENTS

2004/0027291 A1 * 2/2004 Zhang et al. ..... 343/700 MS
2004/0090368 A1 * 5/2004 Channabasappa et al. .. 343/700 MS

* cited by examiner

*Primary Examiner*—Hoang V. Nguyen
(74) *Attorney, Agent, or Firm*—David S. Kalmbaugh

(57) ABSTRACT

A TM cylindrical shaped microstrip antenna array which transmits telemetry data and which is adapted for use on weapons systems such as a missile or smart bomb. The microstrip antenna operates at a TM frequency band of 2210 MHz+/−2.5 MHz. The microstrip antenna is a Linear Polarized microstrip antenna with wrap around capability for a five inch diameter projectile and is constrained to a width of 1.5 inches. The microstrip antenna includes a six aligned copper antenna elements, and a copper etched feed network which provides for transmitted signals which are in phase and have equal amplitudes.

21 Claims, 5 Drawing Sheets

REDUCED SIZE TM CYLINDRICAL SHAPED MICROSTRIP ANTENNA ARRAY

This application is a continuation-in-part of U.S. patent application Ser. No. 10/648,715, filed Aug. 27, 2003.

BACKGROUND OF THE INVENTION

1. Field of the Invention

The present invention relates generally to a microstrip antenna for use on a weapons system to transmit telemetry data. More specifically, the present invention relates to a reduced size TM cylindrical shaped microstrip antenna array which transmits telemetry data and which is adapted for use in a small area on a weapons system such as a missile.

2. Description of the Prior Art

In the past microstrip antenna arrays which are used to transmit telemetry data from a weapons system to a ground station via an RF carrier signal, have required considerable space on board the weapons system to adequately separate the antenna feed network from the antenna elements which prevents the antenna feed network from becoming EM coupled to the antenna elements for the antenna array. Typically, when adequate space on the weapons system is not available, the microstrip antenna arrays have used multiple dielectric layers and feed lines have been placed on a lower layer so that the feed line width can be made very narrow which results in reduced spacing to the antenna elements.

Now, however, there is a need to significantly reduce the size of the microstrip antenna elements and its feed network so that the microstrip antenna array can be used on a small diameter weapons systems.

SUMMARY OF THE INVENTION

The present invention overcomes some of the difficulties of the past in that comprises a highly efficient microstrip antenna having an cylindrical shaped array of antenna elements which require considerably less space than other microstrip antenna arrays designed for use in confined spaces within a weapons system such as a missile, a smart bomb or the like.

The present invention comprises a TM cylindrical shaped microstrip antenna array which transmits telemetry data and which is adapted for use on weapons systems such as a missile or smart bomb. The microstrip antenna operates at a TM frequency band of 2210 MHz+/−2.5 MHz. The microstrip antenna is a Linear Polarized microstrip antenna with wrap around capability for a five inch diameter projectile and is constrained to a width of 1.5 inches. The microstrip antenna includes a six aligned copper antenna elements, and a copper etched feed network which provides for transmitted signals which are in phase and have equal amplitudes, and a depth of 0.5 inches. The RF output signal from a single 50-ohm output coaxial SMMB connector results in microstrip antenna 20 producing a quasi-omni directional radiation pattern with the roll plane cut at −4 dBi (−4 decibels) or better.

The TM cylindrical shaped microstrip antenna array has three stacked dielectric layers with the upper most dielectric layer comrpising a cover board, the middle layer comprising a circuit board and the bottom layer comprising a ground board. The circuit board includes six copper antenna elements on its upper surface, a first etched copper cross hatch pattern which is positioned in proximity to each of the six antenna elements, a feed network on its bottom surface and a second etched copper cross hatch pattern which is positioned in proximity to the feed network.

The ground board also has an etched copper cross hatch pattern on its upper surface which aligns with the cross hatch pattern on te lower surface of the circuit board and a solid copper ground plane mounted on its lower surface.

Since the layout of the bottom surface of the circuit board is virtually identical to the layout of the upper surface of ground board, microwave signals will EM couple between dielectric layers even though there is a bonding film which separates the circuit board from the ground board. This unique feature of the mirostrip antenna array allows the vias or copper plated through holes on the circuit board to EM couple to the vias on the ground board thereby providing an electrical connection for the circuit board to the copper ground plane on the bottom surface of ground board.

DETAILED DESCRIPTION OF THE PREFERRED EMBODIMENT

Figure 1:
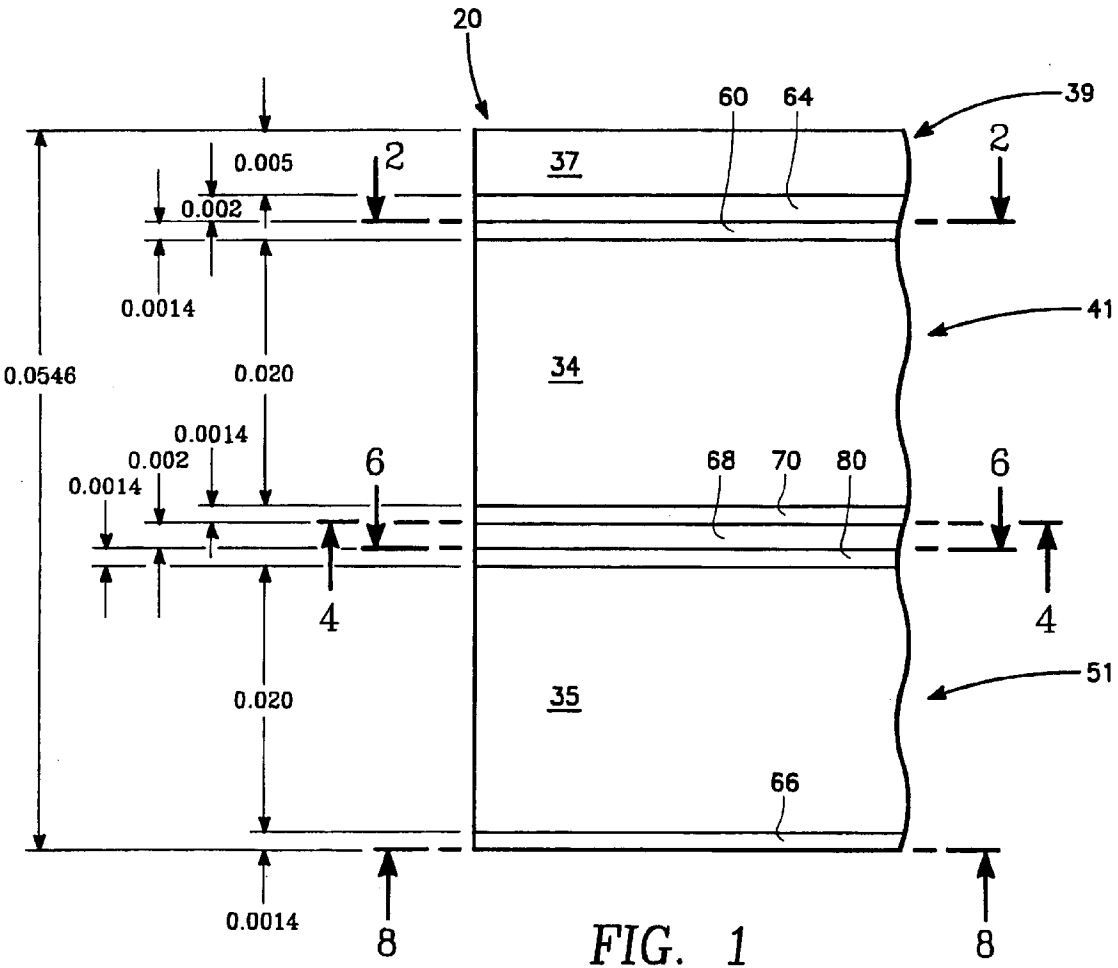
FIG. 1 illustrates a side view of the reduced size TM cylindrical shaped microstrip antenna comprising the present invention.
Figure 2:
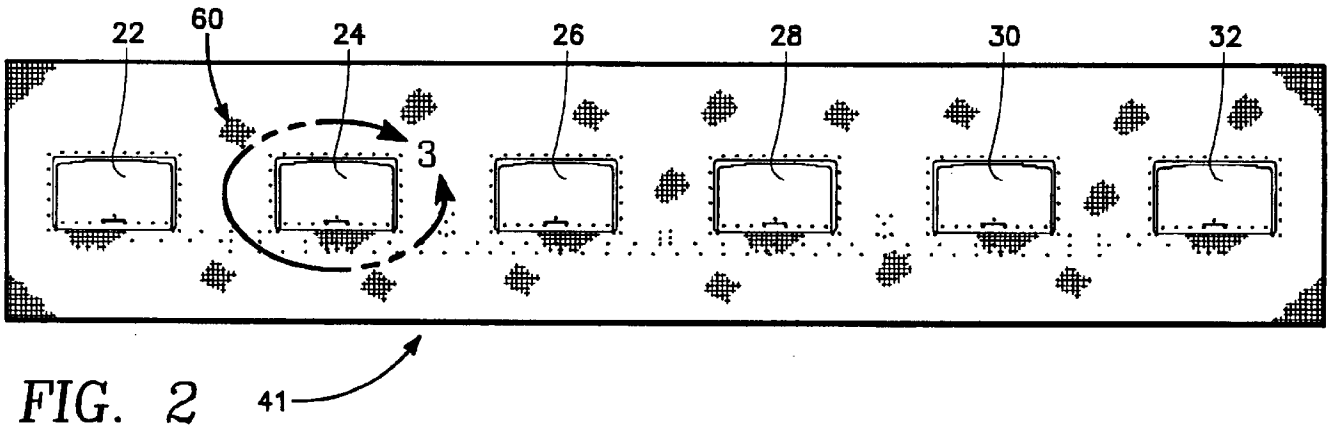
FIG. 2 illustrates the top copper layer of a circuit board which includes the antenna elements for the reduced size TM cylindrical shaped microstrip antenna comprising the present invention.
Figure 3:
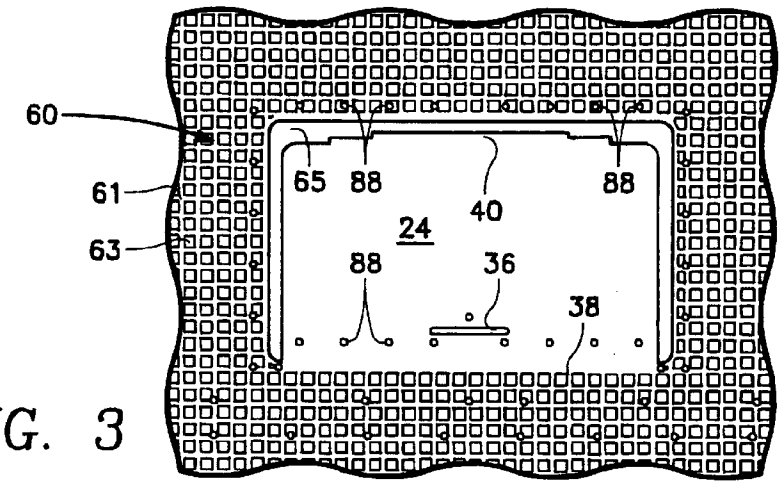
FIG. 3 is an exploded view taken along line 3—3 of FIG. 2 illustrating the tuning tabs and slot for each of the antenna elements and the copper cross hatch pattern for the circuit board of FIG. 2.

Referring to FIGS. 1, 2 and 3, there is shown a reduced size TM cylindrical shaped microstrip antenna, designated generally by the reference numeral 20, which is adapted to transmit telemetry data from a weapons system, such as a missile, to a ground station or other receiving station. TM cylindrical shaped microstrip antenna 20 is designed to operate at a TM frequency band of 2210 MHz+/−2.5 MHz. Microstrip Antenna 20 is a Linear Polarized microstrip antenna with wrap around capability for a five inch diameter projectile and is constrained to a width of 1.5 inches and a depth of 0.5 inches. The RF output signal from a single 50-ohm output coaxial SMMB connector results in microstrip antenna 20 producing a quasi-omni directional radiation pattern with the roll plane cut at −4 dBi (−4 decibels) or better. The overall length of microstrip antenna 20 is 15.515 inches and its overall width is 3.000 inches as shown in FIG. 2.

As depicted FIGS. 1, 2 and 3, TM cylindrical shaped microstrip antenna 20 has six antenna elements 22, 24, 26, 28, 30 and 32 which approximate a rectangle and have overall dimensions of 1.30" by 0.80". As shown in FIG. 1, antenna elements 22, 24, 26, 28, 30 and 32 are aligned with one another are equally spaced apart from one another. Each of the antenna elements 22, 24, 26, 28, 30 and 32 are mounted on a dielectric layer 34 which has an approximate thickness of 0.020 of an inch. Each antenna element 22, 24, 26, 28, 30 and 322 is fabricated from etched copper, includes an elongated impedance matching slot 36 adjacent the lower edge of the antenna element 22, 24, 26, 28, 30 or 32 and a step-shaped tuning tab 40 which comprises the upper edge of each antenna element 22, 24, 26, 28, 30 and 32. The elongated opening 36 in each antenna element 22, 24, 26, 28, 30 and 32 is approximately 0.25 of in inch in length and operates to reduce the size of microstrip antenna 20 and assist in matching the antenna elements 22, 24, 26, 28, 30 and 32 to the antenna feed line of feed network 42 illustrated in FIG. 4. The step shaped tuning tabs 40 for each antenna element 22, 24, 26, 28, 30 and 32 allow the designer to fine tune microstrip antenna 20 to its operating frequency of 2210 MHz+/−2.5 MHz. The antenna elements 22, 24, 26, 28, 30 and 32 transmit telemetry data via a microwave carrier signal/radio frequency (RF) signal to a ground station or other receiving station.

Dielectric substrate 34 (depicted in FIG. 1), which with the antenna elements 22, 24, 26, 28, 30 and 32 (depicted in FIG. 2), and the feed network 42 (depicted in FIG. 4) for antenna comprises the circuit board 41 of microstrip antenna 20, has an upper portion 44 (depicted in FIG. 4) above antenna elements 22, 24, 26, 28, 30 and 32, and a lower portion 46 (depicted in FIG. 4) below antenna elements 22, 24, 26, 28, 30 and 32. The upper portion 44 and lower portion 46 of circuit board 41, which each have a width of 0.75 of an inch, are machined off during the fabrication process of microstrip antenna 20. When antenna 20 is fully assembled only the middle portion 48 of circuit board 41 remains. The middle portion 48 of circuit board 41 has a width of one inch.

At this time it should be noted that microstrip antenna 20 when mounted on a projectile has an overall length of 15.515 inches and a width of one inch. The cover board 39, the circuit board 41 and ground board 51 each have 0.75 inch wide section located at the top and bottom of the board machined off prior to mounting antenna 20 on a projectile.

As depicted in FIGS. 2 and 3, circuit board 41 also includes an etched copper cross hatch pattern 60 which is positioned around each of the antenna elements 22, 24, 26, 28, 30 and 32 and covers the remainder of the upper surface of dielectric layer 34. The etched copper cross hatch pattern 60 has 0.02 inch wide copper traces or strips 61 spaced apart by a 0.05 inch rectangular shaped opening 63 exposing the upper surface of dielectric layer 30. The 0.02 inch wide copper traces/strips 61 and the 0.05 inch openings 63 are best depicted in FIG. 2.

As shown in FIG. 3, a dielectric gap 65 having a width of 0.05 of an inch is provided around the upper edge 40 and the sides 43 and 45 of antenna element 24 which separates the antenna element 24 from etched copper cross hatch pattern 60. Each of the other antenna elements 22, 26, 28, 30 and 32 each have a 0.05 inch dielectric gap around their upper edge and sides which separates the antenna element 22, 26, 28, 30 or 32 from copper cross hatch pattern 60.

Figure 5:
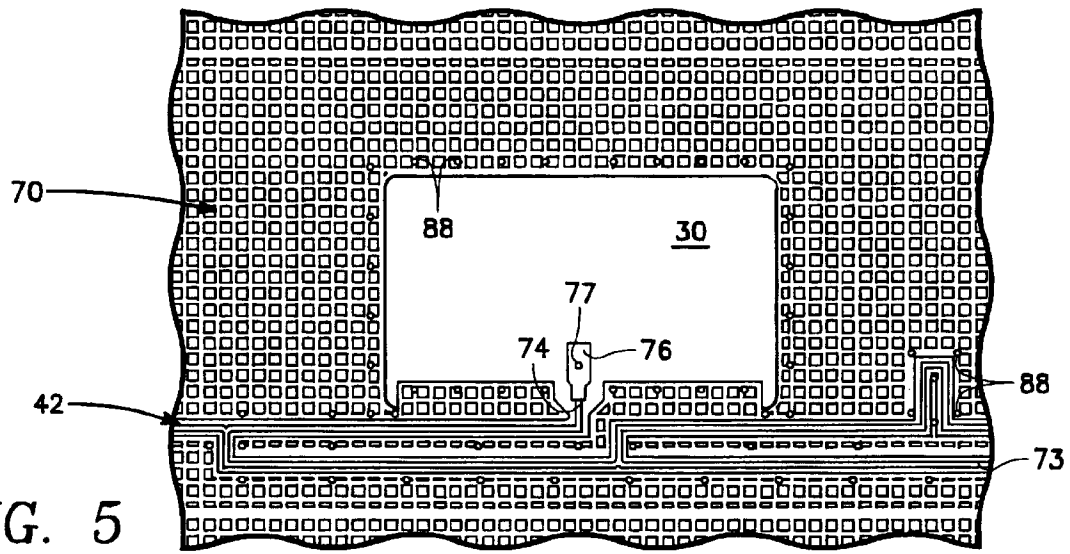
FIG. 5 is an exploded view taken along line 5—5 of FIG. 4 illustrating the copper cross hatch pattern for the bottom copper layer of the circuit board of FIG. 4.

At this time it should be noted that the exploded view of FIG. 3 illustrates in detail the copper cross hatch pattern 60 for the circuit board 41 of FIG. 1. As shown in FIG. 5, the bottom copper layer of circuit board 41 includes an etched copper cross hatch pattern 70 which is identical to the copper cross hatch pattern 60 on the top copper layer of circuit board 31. As shown FIG. 7, the top copper layer of a ground board 51 includes an etched copper cross hatch pattern 80 which is identical to and in alignment with copper cross hatch pattern 70 (illustrated in FIG. 5) on circuit board 41.

The copper cross hatch pattern 60 (illustrated in FIG. 3) of circuit board 41 operates as a solid ground plane to the microwave frequencies of the RF carrier signals transmitted by microstrip antenna 20 and also isolates the antenna elements 22, 24, 26, 28, 30 and 32 of microstrip antenna 20 from the antenna feed network 42 for antenna 20 which is mounted on the bottom surface of dielectric layer 34 below copper cross hatch pattern 60. Since the copper cross hatch pattern 60 exposes a substantial of dielectric substrate 30, there a high percentage of dielectric-to-dielectric bonding area available to secure dielectric layer 52 to a dielectric layer 37.

As shown in FIG. 1, the bonding film 64 between the bottom surface of dielectric layer 37 and the top surface of dielectric layer 34 secures dielectric layer 34 to dielectric layer 37. The bonding film 64 has a thickness of 0.002 of an inch. Dielectric layer 37 has a thickness of 0.005 of an inch and functions as the cover board 39 for microstrip antenna 20.

Figure 8:
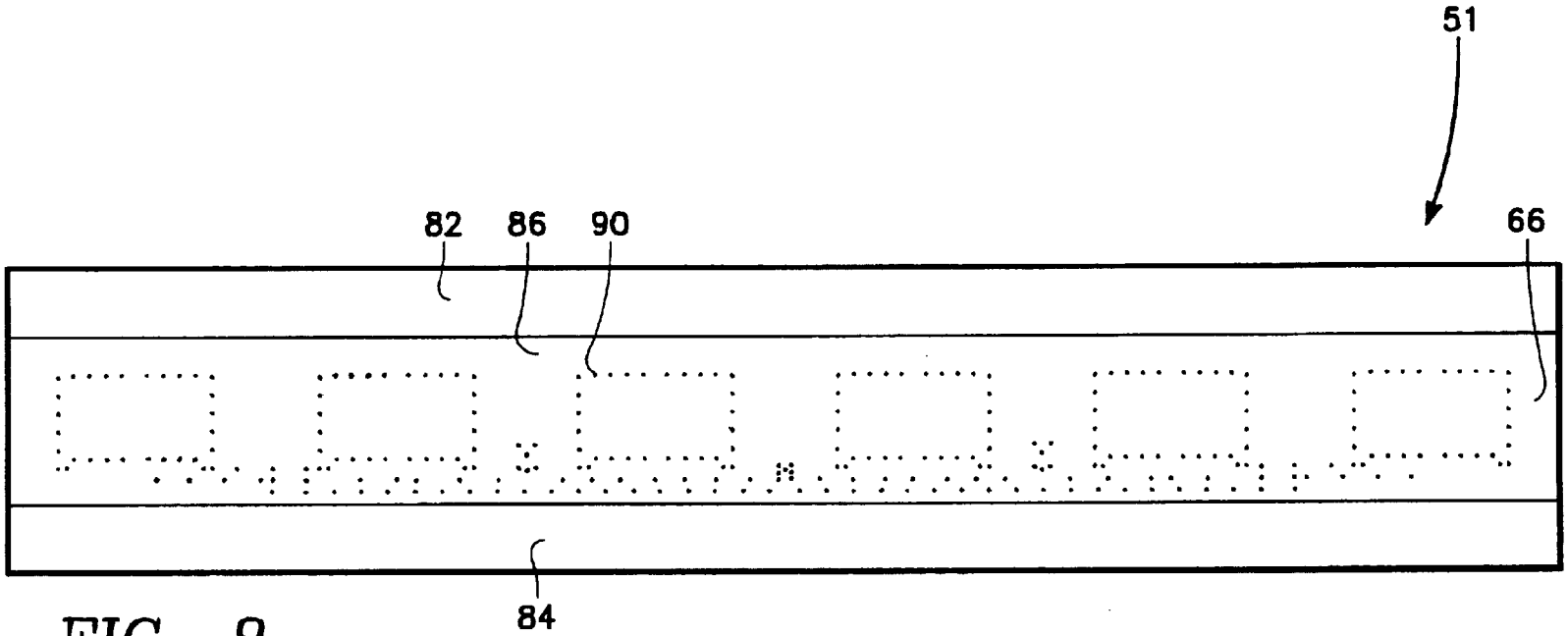
FIG. 8 illustrates the solid copper ground plane of the ground board of FIG. 6.

The copper antenna elements 22, 24, 26, 28, 30 and 38 and ground plane cross hatch pattern 60 are specified as one ounce copper cladding. The one ounce copper cladding ground plane and antenna elements have a thickness of 0.0014 of an inch. Dielectric layers 34 and 35 each have a thickness of 0.02 of an inch. Dielectric layer 35 is the ground board 51 for microstrip antenna 20, and its bottom surface has a solid copper ground plane 66 affixed thereto. Copper ground plane 66, which is depicted in FIG. 8, has a thickness of 0.0014 of an inch. A 0.002 of an inch bonding film 68 secures dielectric layer 34 to dielectric layer 35.

At this time, it should be noted that the cover board 39, the circuit board 41 and the ground board 51 for the reduced size TM cylindrical shaped microstrip antenna comprising the present invention are fabricated using standard printed circuit board technology. The cover board which is dielectric layer 37 is fabricated from a laminate material RT/Duroid 5870 commercially available from Rogers Corporation of Rogers, Conn. The circuit board 41 and the ground board 51 are fabricated from a laminate material RT/Duroid 6002 also commercially available from Rogers Corporation.

Referring to FIGS. 2, 3, 4 and 5, the feed network 42 matches a 50 ohm input impedance to the antenna feed network input 72 which is located near the center of microstrip antenna 20. The feed network 42 distributes microwave signals to antenna elements 22, 24, 26, 28, 30 and 32 with equal amplitude and phase. The feed network 42, which includes a main transmission line 73 and a plurality of branch transmission lines 74, is configured such that the transmission line length from the antenna feed network input 72 to the antenna element feed terminal 76 is identical for each of the six antenna elements 22, 24, 26, 28, 30 and 32. This insures that the microwave signals transmitted by each of the antenna elements 22, 24, 26, 28, 30 and 32 are in phase and have equal amplitudes. A via or plated through hole 77 from the antenna element feed terminal to the antenna element connects each antenna element 22, 24, 26, 28, 30 and 32 to its associated feed terminal 76. The main transmission line 76 and branch transmission lines 77 of feed network 42 are fabricated from etched copper.

Figure 6:
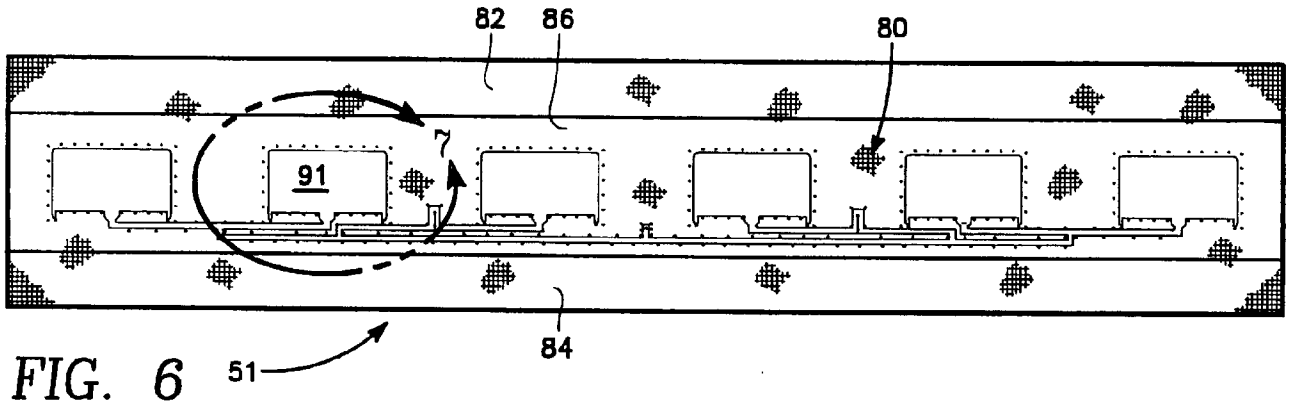
FIG. 6 illustrates the top copper layer of a ground board for the microstrip antenna comprising the present invention.

Referring to FIGS. 1–5, the top layer of ground board 51 is a mirror image of the bottom layer of circuit board 41 except for feed network 42. When microstrip antenna 20 is fully assembled as shown in FIG. 6, cross hatch pattern 70 is in alignment with cross hatch pattern 80. This results in EM coupling of microwave signals between the circuit board 41 land ground board 51 even though there is a 0.002 thick bonding film 68 separating the two dielectric layers 34 and 35.

As shown in FIG. 6, dielectric substrate 35, which with the cross hatch pattern 80 and copper ground plane 66 comprises the ground board 51 of antenna 20, has an upper portion 82 above cross hatch pattern 80, a lower portion 84 and a middle portion 86. In a manner identical to the machining process for circuit board 41, the upper portion 82 and lower portion 84: of ground board 51, are machined off during the fabrication and assembly process for microstrip antenna 20. When microstrip antenna 20 is fully assembled only the middle portion 86 of ground board 51 remains. The middle portion 86 of ground board 51 has a width of one inch, while the upper portion 82 and lower portion 84 of ground board 51 each have a width of 0.75 of an inch. In an identical manner, the upper portion and lower portion of the cover board 39 are machined off such the cover board 39 has an overall width of one inch.

Figure 4:
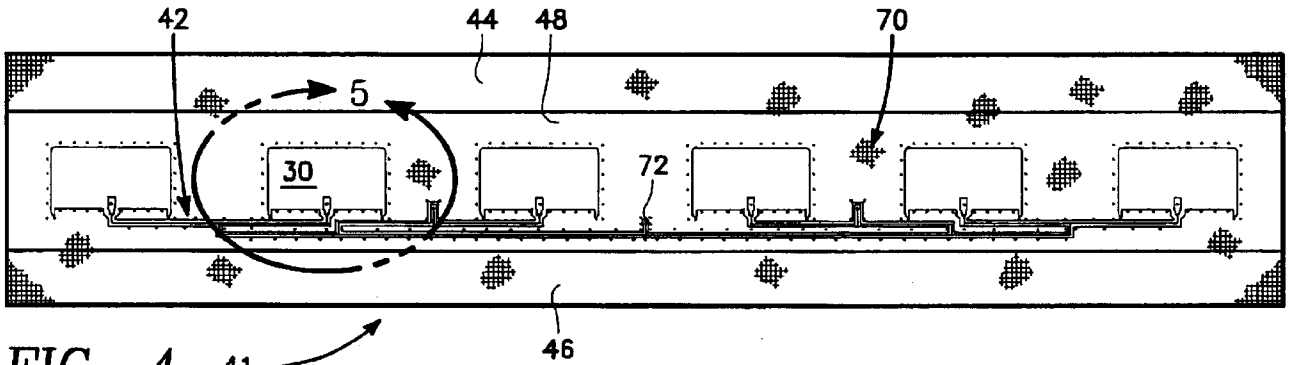
FIG. 4 illustrates the bottom copper layer of the circuit board of FIG. 2 which includes a feed network for the antenna elements of the microstrip antenna of FIG. 1.

As shown in FIGS. 4 and 5, the circuit board 41 includes approximately 270 copper plated through holes or vias 88 which are used to equalize potential on both sides of the circuit board 41. The copper plated through holes 88 are positioned at the edge of dielectric gap 65, along the lower edge 88 of each antenna elements 22, 24, 26, 28, 30 and 32 and also at the edge of the antenna feed network 42 for antenna 20.

Figure 7:
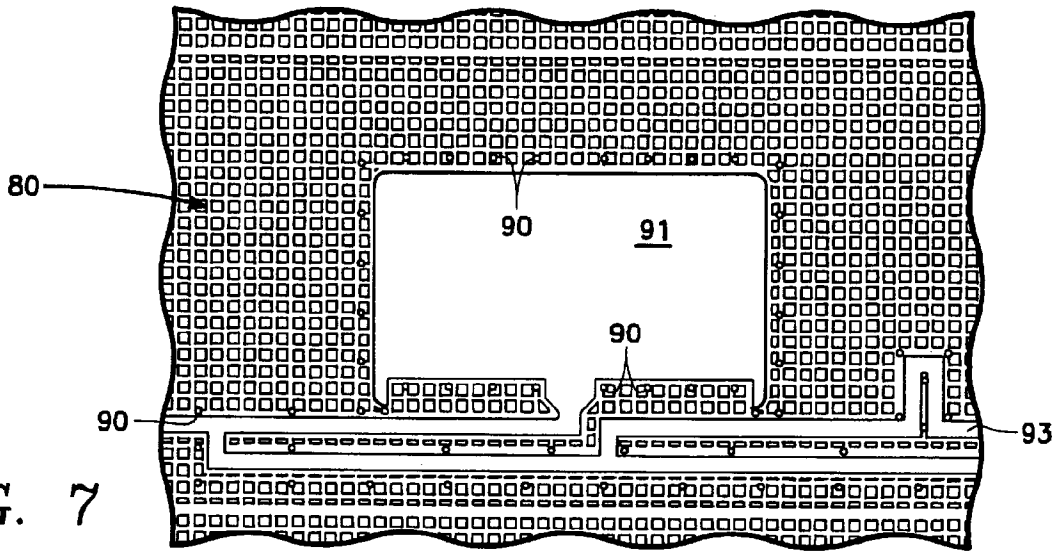
FIG. 7 is an exploded view taken along line 7—7 of FIG. 6 illustrating the copper cross hatch pattern for the top copper layer of the ground board of FIG. 6.

Referring to FIGS. 4, 5, 6 and 7, the ground board 51 also includes approximately 270 copper plated through holes or vias 90 with each via 90 aligning one of the vias 88 of circuit board 41. As shown in FIGS. 6 and 7, the vias 90 are position around the edge of six rectangular shaped dielectric patches 91 within ground board 51 which align with the six antenna elements 22, 24, 26, 28, 30 and 32 and a dielectric area 93 within ground board 51 which aligns with the feed network 42 of circuit board 41. If too few vias 88 and 90 are included in the circuit board 41 and ground board 51, the antenna feed network 42 for antenna 20 becomes coupled to the antenna elements 22, 24, 26, 28, 30 and 32.

Referring to FIGS. 4, 5, 6 and 7, the layout of the bottom surface of circuit board 41 is identical to the layout of the upper surface of ground board 51 except for the antenna feed network 42 on the bottom surface of ground board 51. This allows microwave signals to EM couple between dielectric layers 34 and 35 even though bonding film 68 separates dielectric layers 34 and 35. This unique feature of antenna 20 allows the vias 88 on circuit board 41 to couple to the vias 90 on ground board 51 thereby electrically connecting the circuit board 31 to copper ground plane 66 on the bottom surface of ground board 51.

From the foregoing, it is readily apparent that the present invention comprises a new, unique and exceedingly useful TM cylindrical shaped microstrip antenna array for receiving telmetry signals which constitutes a considerable improvement over the known prior art. Many modifications and variations are possible in light of the above teachings. It is therefore to be understood that within the scope of the appended claims that the invention may be practiced otherwise than as specifically described.

What is claimed is:

1. A reduced size TM cylindrical shaped microstrip antenna array comprising:

(a) a first dielectric layer;

(b) a plurality of rectangular shaped antenna elements mounted on an upper surface of said first dielectric layer, said antenna elements being aligned with one another and fabricated from copper, said antenna elements being adapted to transmit RF carrier signals containing telmetry data;

(c) a first copper cross hatch pattern mounted on the upper surface of said first dielectric layer around a periphery for each of said antenna elements wherein a gap forms between first, second and third edges of the periphery of each of said antenna elements and said copper cross hatch pattern;

(d) an antenna feed network mounted on a bottom surface of said first dielectric layer for connecting each of said antenna elements to an antenna feed network input terminal, said antenna feed network including a plurality of transmission lines configured to provide for an equal transmission line length from said antenna feed network input terminal to each of said antenna elements such that the RF carrier signals transmitted by each of said antenna elements are in phase and have equal amplitudes;

(e) a second copper cross hatch pattern mounted on the bottom surface of said first dielectric substrate in proximity to said antenna feed network;

(f) a second dielectric layer positioned below said first dielectric layer in alignment with said first dielectric layer;

(g) a third copper cross hatch pattern mounted on an upper surface of said second dielectric layer, said third copper cross hatch pattern being in alignment and substantially identical to said second cross hatch pattern; and (h) a solid copper ground plane affixed to a bottom surface of said second dielectric layer.

2. The TM cylindrical shaped microstrip antenna array of claim 1 wherein said antenna feed network includes a main transmission line connected to said antenna feed network input terminal and a plurality of branch transmission lines, each of said branch transmission lines having one end thereof connected to one of said antenna elements and an opposite end thereof connected to said main transmission line.

3. The TM cylindrical shaped microstrip antenna array of claim 1 operates at a TM frequency band of 2210 MHz+/−2.5 MHz.

4. The TM cylindrical shaped microstrip antenna array of claim 1 wherein said TM cylindrical shaped microstrip antenna array fits on a projectile having a diameter of five inches, said TM cylindrical shaped microstrip array having a width of 1.5 inches, and a depth of 0.5 inches.

5. The TM cylindrical shaped microstrip antenna array of claim 1 further comprising a bonding film positioned between said first dielectric layer and said second dielectric layer, said bonding film securing the bottom surface of said first, dielectric layer to the upper surface of said second dielectric layer.

6. The TM cylindrical shaped microstrip antenna array of claim 1 further comprising:

(a) a third dielectric layer positioned above said first dielectric layer in alignment with said first dielectric layer; and (b) a bonding film positioned between said first dielectric layer and said third dielectric layer, said bonding film securing the upper surface of said first dielectric layer to a bottom surface of said third dielectric layer.

7. The TM cylindrical shaped microstrip antenna array of claim 6 wherein said third dielectric layer is a cover for said TM cylindrical shaped microstrip antenna array.

8. The TM cylindrical shaped microstrip antenna array of claim 1 wherein said plurality of rectangular shaped antenna elements comprises six copper antenna elements mounted on an upper surface of said first dielectric layer.

9. The TM cylindrical shaped microstrip antenna array of claim 1 wherein said each of said plurality of antenna elements has an elongated slot located in proximity to the lower edge of said antenna element, said elongated slot in each of said plurality of antenna elements reducing the size of said antenna element, said elongated slot in each of said plurality of antenna elements having an approximate length of 0.25 of an inch.

10. The TM cylindrical shaped microstrip antenna array of claim 1 wherein each of said plurality of antenna elements has a step-shaped tuning tab which comprises the upper edge of each of said antenna elements, said step shaped tuning tab for each of said antenna elements allowing a user to fine tune said TM cylindrical shaped microstrip antenna to an operating frequency of 2210 MHz+/−2.5 MHz.

11. The TM cylindrical shaped microstrip antenna array of claim 1 further comprising a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, wherein the copper plated through holes of said first dielectric layer and the copper plated through holes of said second dielectric layer prevent said antenna feed network from becoming coupled to said antenna elements.

12. The TM cylindrical shaped microstrip antenna array of claim 11 wherein the copper plated through holes of said first dielectric layer and the copper plated through holes of said second dielectric layer each comprise 270 copper plated through holes.

13. The TM cylindrical shaped microstrip antenna array of claim 1 wherein each of said first, second and third copper cross hatch patterns comprises a plurality of 0.02 inch wide copper traces spaced apart by a 0.05 inch rectangular shaped opening.

14. A reduced size TM cylindrical shaped microstrip antenna array comprising:

(a) a first dielectric layer;

(b) six rectangular shaped antenna elements mounted on an upper surface of said first dielectric layer, said six antenna elements being aligned with one another and fabricated from copper, said six antenna elements being adapted to transmit RF carrier signals containing telmetry data;

(c) a first copper cross hatch pattern mounted on the upper surface of said first dielectric layer around a periphery for each of said six antenna elements wherein a gap forms between first, second and third edges of the periphery of each of said six antenna elements and said copper cross hatch pattern;

(d) an antenna feed network mounted on a bottom surface of said first dielectric layer for connecting each of said six antenna elements to an antenna feed network input terminal, said antenna feed network including a plurality of transmission lines configured to provide for an equal transmission line length from said antenna feed network input terminal to each of said six antenna elements such that the RF carrier signals transmitted by each of six said antenna elements are in phase and have equal amplitudes;

(e) a second copper cross hatch pattern mounted on the bottom surface of said first dielectric substrate in proximity to said antenna feed network;

(f) a second dielectric layer positioned below said first dielectric layer in alignment with said first dielectric layer;

(g) a third copper cross hatch pattern mounted on an upper surface of said second dielectric layer, said third copper cross hatch pattern being in alignment and substantially identical to said second cross hatch pattern;

(h) a solid copper ground plane affixed to a bottom surface of said second dielectric layer; and (i) a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, wherein the copper plated through holes of said first dielectric layer and the copper plated through holes of said second dielectric layer prevent said antenna feed network from becoming coupled to said antenna elements.

15. The TM cylindrical shaped microstrip antenna array of claim 14 wherein the copper plated through holes of said first dielectric layer and the copper plated through holes of said second dielectric layer each comprise 270 copper plated through holes.

16. The TM cylindrical shaped microstrip antenna array of claim 14 further comprising a bonding film positioned between said first dielectric layer and said second dielectric layer, said bonding film securing the bottom surface of said first dielectric layer to the upper surface of said second dielectric layer.

17. The TM cylindrical shaped microstrip antenna array of claim 14 further-comprising:

(a) a third-dielectric layer positioned above said first dielectric layer in alignment with said first dielectric layer; and (b) a bonding film positioned between said first dielectric layer and said third dielectric layer, said bonding film securing the upper surface of said first dielectric layer to a bottom surface of said third dielectric layer.

18. The TM cylindrical shaped microstrip antenna array of claim 14 wherein said each of said six antenna elements has an elongated slot located in proximity to the lower edge of said antenna element, said elongated slot in each of said six antenna elements reducing the size of said antenna element, said elongated slot in each of said six antenna elements having an approximate length of 0.25 of an inch.

19. The TM cylindrical shaped microstrip antenna array of claim 14 wherein each of said six antenna elements has a step-shaped tuning tab which comprises the upper edge of each of said antenna elements, said step shaped tuning tab for each of said six antenna elements allowing a user to fine tune said TM cylindrical shaped microstrip antenna to an operating frequency of 2210 MHz+/−2.5 MHz.

20. A reduced size TM cylindrical shaped microstrip antenna array comprising:

(a) a first dielectric layer;

(b) a plurality of rectangular shaped antenna elements, mounted on an upper surface of said first dielectric layer, said antenna elements being aligned with one another and fabricated from copper, said antenna elements being adapted to transmit RF carrier signals containing telmetry data, wherein said each of said plurality of antenna elements has an elongated slot located in proximity to the lower edge of said antenna element, said elongated slot in each of said plurality of antenna elements reducing the size of said antenna element, said elongated slot in each of said plurality of antenna elements having an approximate length of 0.25 of an inch;

(c) a first copper cross hatch pattern mounted on the upper surface of said first dielectric layer around a periphery for each of said antenna elements wherein a gap forms between first, second and third edges of the periphery of each of said antenna elements and said copper cross hatch pattern;

(d) an antenna feed network mounted on a bottom surface of said first dielectric layer for connecting each of said antenna elements to an antenna feed network input terminal, said antenna feed network including a plurality of transmission lines configured to provide for an equal transmission line length from said antenna feed network input terminal to each of said antenna elements such that the RF carrier signals transmitted by each of said antenna elements are in phase and have equal amplitudes;

(e) a second copper cross hatch pattern mounted on the bottom surface of said first dielectric substrate in proximity to said antenna feed network;

(f) a second dielectric layer positioned below said first dielectric layer in alignment with said first dielectric layer;

(g) a third copper cross hatch pattern mounted on an upper surface of said second dielectric layer, said third copper cross hatch pattern being in alignment and substantially identical to said second cross hatch pattern, wherein each of said first, second and third copper cross hatch patterns comprises a plurality of 0.02 inch wide copper traces spaced apart by a 0.05 inch rectangular shaped opening; and (h) a solid copper ground plane affixed to a bottom surface of said second dielectric layer;

(i) a plurality of copper plated through holes positioned within said first dielectric layer and a plurality of plated through holes positioned within said second dielectric layer, the copper plated through holes of said first dielectric layer aligning with the copper plated through holes of said second dielectric layer, the copper plated through holes of said first dielectric layer being EM coupled to the copper plated through holes of said second dielectric layer, the copper plated through holes of said first dielectric layer and the copper plated through holes of said second dielectric layer each comprising 270 copper plated through holes, wherein the copper plated through holes of said first dielectric layer and the copper plated through holes of said second dielectric layer prevent said antenna feed network from becoming coupled to said antenna elements;

(j) a first banding film positioned between said firsts dielectric layer and said second dielectric layer, said first bonding film securing the bottom surface of said first dielectric layer to the upper surface of said second dielectric layer;

(k) a third dielectric layer positioned above said first dielectric layer in alignment with said first dielectric layer; and (l) a second bonding film positioned between said first dielectric layer and said third dielectric layer, said second bonding film securing the upper surface of said first dielectric layer to a bottom surface of said third dielectric layer.

21. The TM cylindrical shaped microstrip antenna array of claim 20 wherein each of said plurality of antenna elements has a step-shaped tuning tab which comprises the upper edge of each of said antenna elements, said step shaped tuning tab for each of said antenna elements allowing a user to fine tune said TM cylindrical shaped microstrip antenna to an operating frequency of 2210 MHz+/−2.5 MHz.

* * * * *